US007488033B1

(12) United States Patent
Wang

(10) Patent No.: US 7,488,033 B1
(45) Date of Patent: Feb. 10, 2009

(54) MECHANISM FOR ADJUSTING A SADDLE OF A FITNESS APPARATUS

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 0 days.

(21) Appl. No.: 11/971,892

(22) Filed: Jan. 9, 2008

(51) Int. Cl.
*B62J 1/00* (2006.01)

(52) U.S. Cl. ..... 297/195.11

(58) Field of Classification Search ..... 297/329, 297/195.11, 344.14, 215.13, 215.14, 215.15; 482/57

See application file for complete search history.

(56) References Cited

U.S. PATENT DOCUMENTS 3,150,898 A * 9/1964 Knudson ..... 297/329
4,586,706 A * 5/1986 Chen ..... 482/62
5,035,418 A * 7/1991 Harabayashi ..... 482/62
5,312,311 A * 5/1994 Pearson ..... 482/57
5,971,894 A * 10/1999 Chen ..... 482/57
6,056,362 A * 5/2000 de la Haye ..... 297/314

* cited by examiner

*Primary Examiner*—Milton Nelson, Jr.
(74) *Attorney, Agent, or Firm*—Troxell Law Office PLLC

(57) ABSTRACT

A mechanism for adjusting a saddle of a fitness apparatus that employs two telescopic adjusting elements for an easy adjustment of the inclination of the saddle tube of the fitness apparatus as well as the position of the saddle in all directions. Moreover, both of the telescopic adjusting elements each are provided with a positioning element and a plurality of the adjusting holes for an easy locking and a rapid releasing effect.

2 Claims, 4 Drawing Sheets

MECHANISM FOR ADJUSTING A SADDLE OF A FITNESS APPARATUS

BACKGROUND OF THE INVENTION

1. Fields of the Invention

The invention relates to a mechanism for adjusting a saddle of a fitness apparatus, and more particularly, to a mechanism that ensures an optimal adjustment by moving a saddle tube and a saddle in all directions, thereby meeting all of the use requirements.

2. Description of the Related Art

As well-known, many of the fitness apparatuses (such as fitness bikes, rowing exercise apparatuses, etc.) have a saddle for a rider to take a fitness exercise. In order to achieve a smooth operation of the fitness apparatus for every operator, the saddle is movably mounted for operators with different height.

The conventional mechanism for adjusting a saddle of a fitness apparatus ensures only an up-and-down adjustment in vertical or slanting vertical direction. As a result, the operator has no other choice than to inactively accept a single exercise position according to his body height. This position can even not meet the requirements of the sitting comfort and the personal height of the operator. This requires a further improvement.

SUMMARY OF THE INVENTION

An object of the invention to eliminate the above-mentioned drawbacks and to provide a mechanism for adjusting a saddle of a fitness apparatus that employs two telescopic adjusting elements for an easy adjustment of the inclination of the saddle tube of the fitness apparatus as well as the position of the saddle in all directions, thereby meeting the personal requirements of each operator in use.

According to the invention, a mechanism for adjusting a saddle of a fitness apparatus includes a support shaft and two telescopic adjusting elements. Meanwhile, a saddle tube is provided for a sliding shift of the saddle thereon. Based on the above-mentioned configuration, a free adjustment of the inclination of the saddle tube and the front and rear position of the saddle is ensured.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 1:
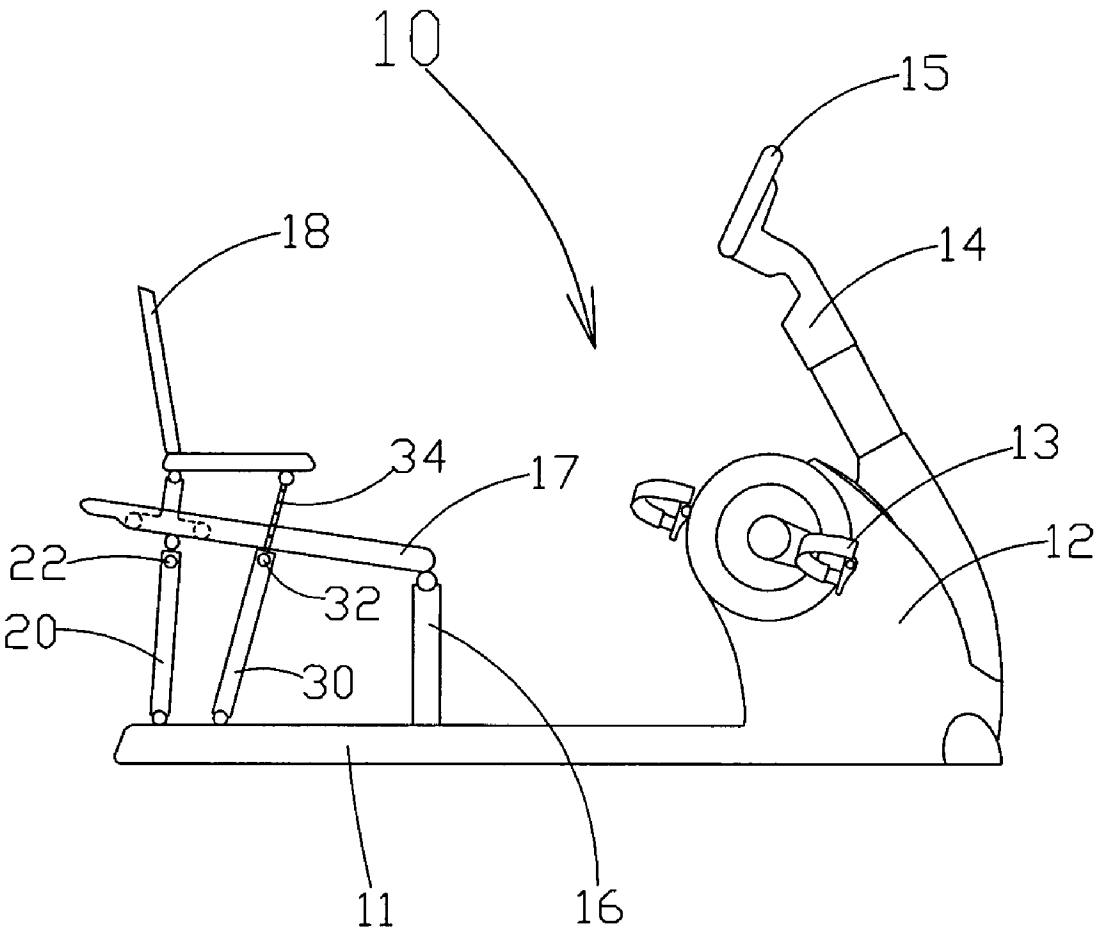
FIG. 1 is a schematic drawing of a preferred embodiment of the invention.
Figure 2:
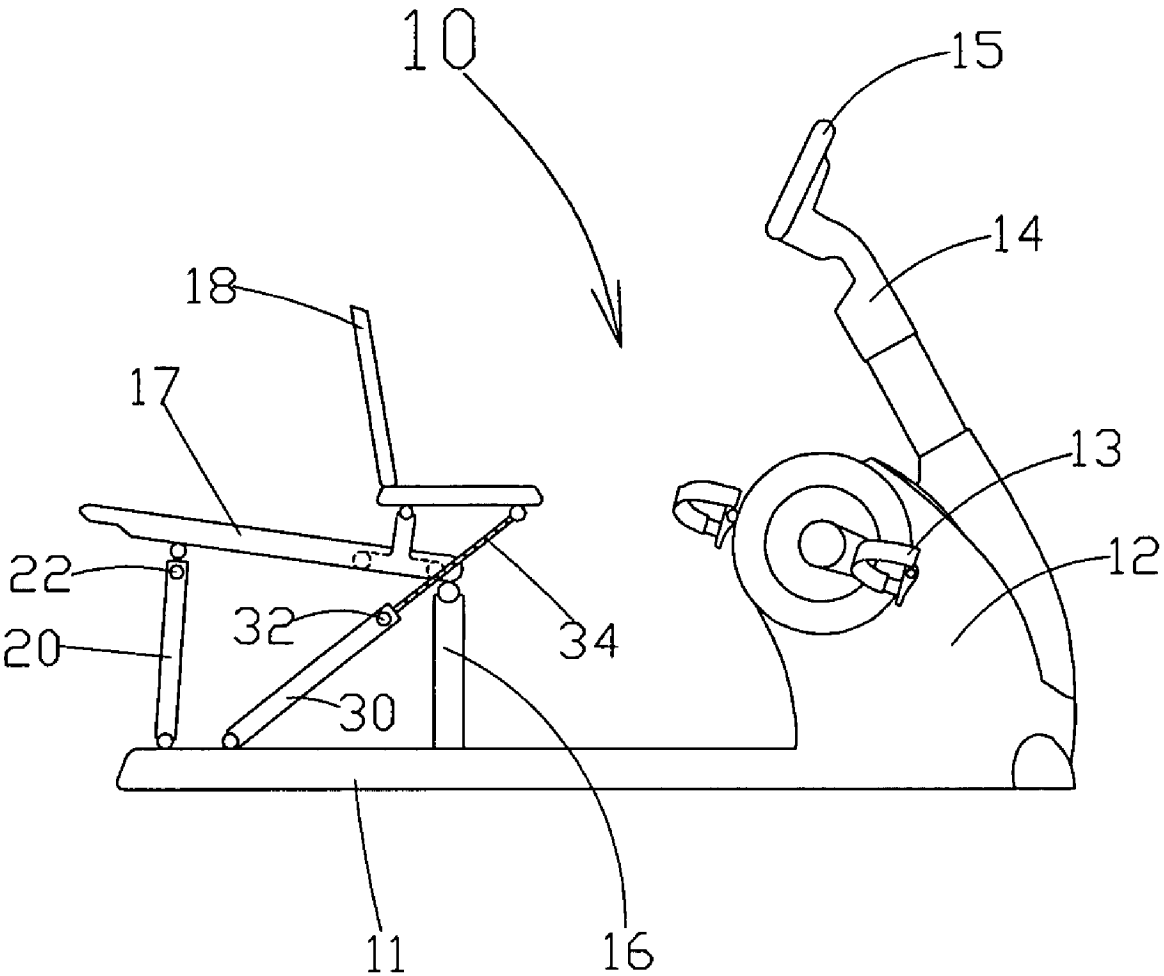
FIG. 2 is a schematic drawing in adjusting the structure of FIG. 1.

Referring to FIGS. 1 and 2, a fitness bike 10 to which the invention is applied has a base 11. A transmission unit 12 (not shown), a pedal unit 13, a front support 14 and an electronic console 15 are installed at the front end of the base 11. A support shaft 16 is disposed near the center of the base 11 of the fitness bike 10. One end of a saddle tube 17 is pivotally attached to a top end of the support shaft 16 while the other end of the saddle tube 17 is pivotally coupled with a first telescopic adjusting element 20. Meanwhile, the other end of the first telescopic adjusting element 20 is pivotally mounted on the base 11.

A movable saddle 18 is disposed on the saddle tube 17. The front bottom end of the saddle 18 is pivotally coupled with a second telescopic adjusting element 30. Moreover, the other end of the second telescopic adjusting element 30 is pivotally mounted on the base 11 as well. Under the influence of both telescopic adjusting elements 20, 30, the saddle tube 17 and the saddle 18 can be adjusted and shifted for meeting different requirements in use.

In order to achieve an efficient positioning effect of the telescopic adjusting elements 20, 30, both of the telescopic adjusting elements 20, 30 each are provided with a positioning element 22, 32 and a plurality of the adjusting holes 24, 34. In performing the process of the adjustment, the positioning elements 22, 32 have to be disengaged first. After reaching a required position (or a proper adjusting hole 24, 34), the positioning elements 22, 32 are engaged in place again.

Figure 3:
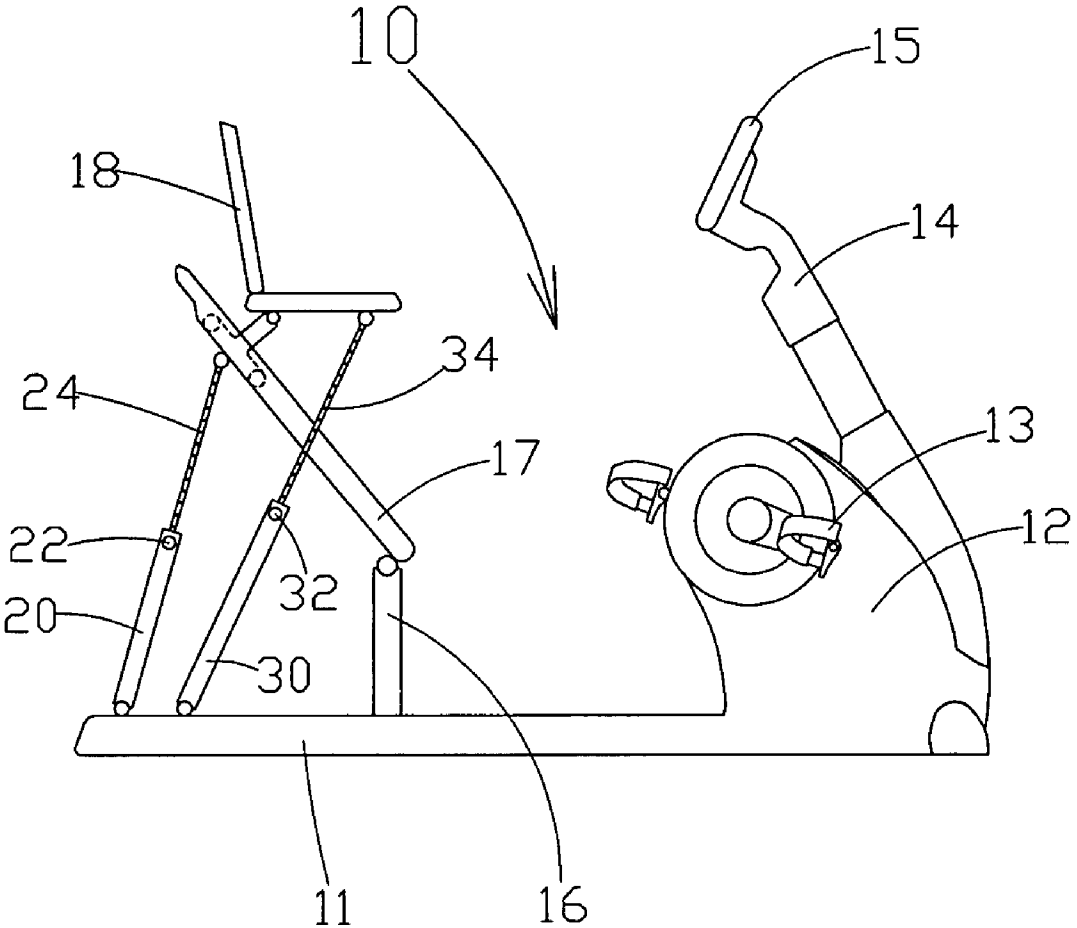
FIG. 3 is another schematic drawing in adjusting the structure of FIG. 1.
Figure 4:
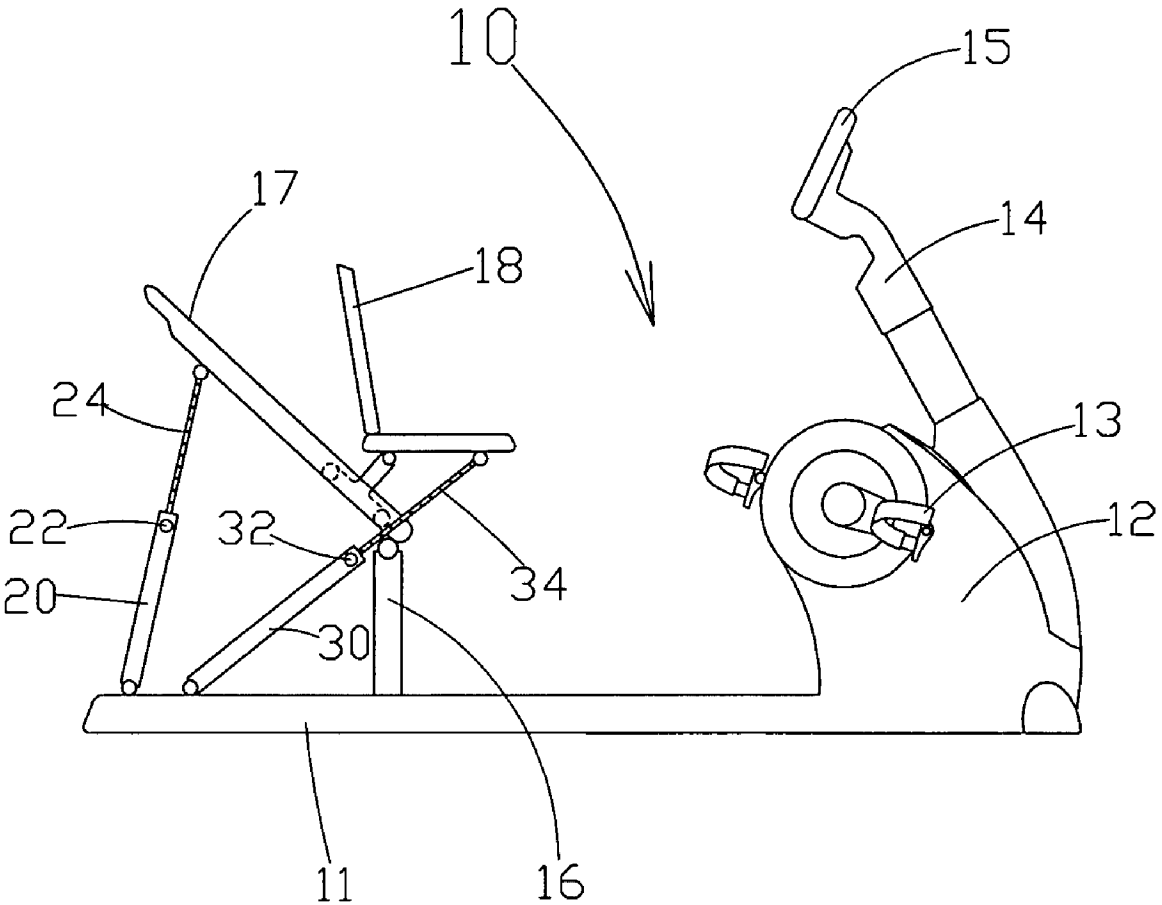
FIG. 4 is a further schematic drawing in adjusting the structure of FIG. 1.

Now, referring to FIGS. 3 and 4, the inclination of the saddle tube 17 and the position of the saddle 18 can be fully adjusted to a great extent. No matter how tall the operator is or at which height a desired exercise position is, an optimal adjustment according to the personal requirements of the operator can be ensured.

The transmission unit 12, the pedal unit 13 and the electronic console 15 are components of the prior art. Their structure, effects and functions are well-known and are not the object of the invention. Thus, no further descriptions thereto are given hereinafter.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A mechanism for adjusting a saddle of a fitness apparatus, having a base, a support shaft being configured to be disposed at a prearranged position of a base of the fitness apparatus, when the saddle is attached to the fitness apparatus, one end of a saddle tube being pivotally attached to a top end of the support shaft while the other end of the saddle tube is pivotally coupled with a first telescopic adjusting element, the other end of the first telescopic adjusting element being configured to be pivotally mounted on the base, a movable saddle being disposed on the saddle tube, a front bottom end of the saddle being pivotally coupled with a second telescopic adjusting element, an other end of the second telescopic adjusting element being configured to be pivotally mounted on the base as well, whereby the saddle tube and the saddle can be adjusted and shifted under the influence of both telescopic adjusting elements for meeting different requirements in use.

2. A mechanism for adjusting a saddle of a fitness apparatus, having a base, a support shaft being configured to be disposed at a prearranged position of a base of the fitness apparatus, when the saddle is attached to the fitness apparatus, one end of a saddle tube being pivotally attached to a top end of the support shaft while the other end of the saddle tube is pivotally coupled with a first telescopic adjusting element, the other end of the first telescopic adjusting element being configured to be pivotally mounted on the base, a movable saddle being disposed on the saddle tube, a front bottom end of the saddle being pivotally coupled with a second telescopic adjusting element, an other end of the second telescopic adjusting element being configured to be pivotally mounted on the base as well, whereby the saddle tube and the saddle can be adjusted and shifted under the influence of both telescopic adjusting elements for meeting different requirements in use, wherein both of the telescopic adjusting elements each are provided with a positioning element and a plurality of adjusting holes.

* * * * *